US005557892A

United States Patent [19]

Lavin

[11] Patent Number: 5,557,892

[45] Date of Patent: Sep. 24, 1996

[54] POWER MAST

[75] Inventor: Kevin R. Lavin, Princeton, Mass.

[73] Assignee: Wolf Coach, Inc., Auburn, Mass.

[21] Appl. No.: 207,926

[22] Filed: Mar. 8, 1994

[51] Int. Cl.[6] ..... B66C 23/06

[52] U.S. Cl. ..... 52/121; 52/118; 52/111; 343/883

[58] Field of Search ..... 52/108, 111, 113, 52/118, 40, 6, 121; 343/883, 875, 901; 212/159, 160, 249, 266, 267, 268, 269

[56] References Cited

U.S. PATENT DOCUMENTS

| | | | |
|---|---|---|---|
| 2,795,303 | 6/1957 | Muehlhause et al. | 52/121 |
| 4,309,854 | 1/1982 | Vendramini | 212/267 X |
| 4,560,074 | 12/1985 | Manning | 212/249 X |
| 4,688,690 | 8/1987 | Gattu et al. | 212/268 |
| 4,691,805 | 9/1987 | Kishi | 52/121 X |
| 4,783,934 | 11/1988 | Langhart et al. | 52/121 X |
| 5,020,957 | 6/1991 | Liston | 212/266 X |
| 5,060,427 | 10/1991 | Bernabe, Jr. | 212/269 X |
| 5,101,215 | 3/1992 | Creaser, Jr. | 343/883 |

OTHER PUBLICATIONS

TMD Telescoping Pneumatic Masts, "Standard Duty Masts", Specifications Sheet No. 201 Issue Date Aug. 11, 1988.

TMD Telescoping Pneumatic Masts, "Heavy Duty Masts – Non–locking", Specifications Sheet No. 202, Issue Date Apr. 1, 1988.

TMD Telescoping Pneumatic Masts, "Heavy Duty Guyed Masts", Specifications Sheet No. 203, Issue Date Mar. 6, 1987.

TMD Telescoping Pneumatic Masts, "Standard Duty Field Masts", Specifications Sheet No. 204, Issue Date May 1, 1986.

TMD Telescoping Pneumatic Masts, "Installation Dimensions", Service Sheet No. 401, Issue Date Feb. 1, 1989.

*Primary Examiner*—Carl D. Friedman
*Assistant Examiner*—Winnie Yip
*Attorney, Agent, or Firm*—Nields & Lemack

[57] ABSTRACT

A power mast for the automatic vertical elevation and retraction of various devices, such as an antenna mounted on a communications vehicle. The mast is cable-driven, having a plurality of individual telescoping sections which allow for an overall collapsed height the same as or only slightly higher than the tallest such individual section. The cable is threaded around a series of pulleys, and is driven by a motor. Constant tension is maintained in the system, so that when in its operating or "up" position, the device is held in a stable condition until retracted.

6 Claims, 9 Drawing Sheets

POWER MAST

BACKGROUND OF THE INVENTION

The design and construction of communication vehicles for receiving and/or transmitting signals requires consideration of numerous parameters, many depending upon the particular application to which the vehicle is being put. For example, weight and balance, axle loading, generator enclosure area, roadability, safety and weather integrity must be carefully considered for each vehicle being designed and built.

One critical component of communication vehicle designs is the antenna. During operation, the height of the antenna relative to the earth must be sufficient to allow for suitable transmission and/or receipt of signals regardless of the location of the vehicle. Such heights often exceed 40 feet. As a result, it is desirable that the antenna be capable of being oriented from its operating or "up" position, to a retracted or "down" position affording reduced air resistance and reduced potential for damage from overhanging obstacles during movement of the vehicle from site to site. Indeed, overall height is restricted by the U.S. Department of Transportation to 13'6".

To that end, pneumatically operated systems conventionally have been employed. However, numerous problems with such devices have arisen. For example, a compressor is necessary to pressurize the entire mast assembly. Over time, leaks develop in the system, resulting in the slow lowering of the mast during operation. If the compressor is designed to switch on upon sensing such lowering, there may be a sudden spike in electrical power which could interfere with the signals being transmitted from or received in the vehicle. Since the mast is lowered by gravity, if the antenna is in the operating up position during an ice or snow storm, freezing of the retractable components can occur, making it impossible to retract the antenna and therefore to move the vehicle.

Other components of other vehicles, such as lighting towers, that are mounted on the vehicle and adapted to extend upwardly suffer from similar difficulties.

It is therefore an object of the present invention to provide a power mast that eliminates the foregoing drawbacks.

It is a further object of the present invention to provide a power mast that automatically elevates and retracts an antenna or other device quickly and easily without pressurizing the system.

SUMMARY OF THE INVENTION

The problems of the prior art have been overcome by the present invention, which provides a power mast for the automatic vertical elevation and retraction of various devices. In one embodiment of the invention, the device is an antenna mounted on a communications vehicle.

In general terms, the present invention is a cable-driven mast, having a plurality of individual telescoping sections which allow for an overall collapsed height the same as or only slightly higher than the tallest such individual section. The cable is threaded around a series of pulleys, and is motor driven. Constant tension is maintained in the system, so that when in its operating or "up" position, the device is held in a stable condition until retracted.

DETAILED DESCRIPTION OF THE INVENTION

Figure 1:
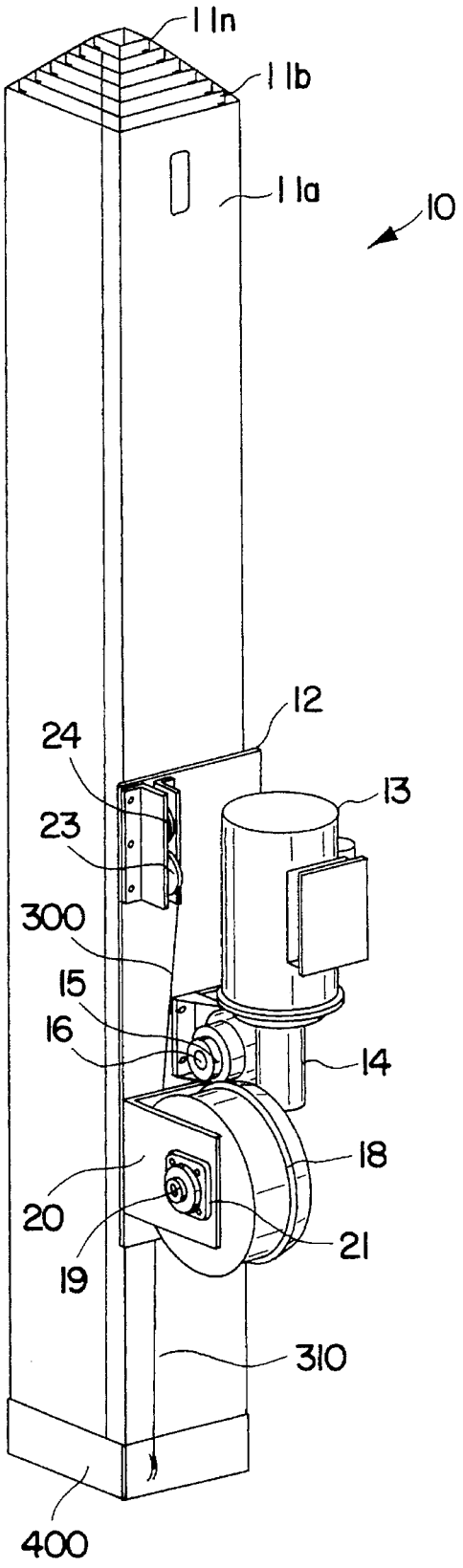
FIG. 1 is a perspective view of the power mast assembly in accordance with one embodiment of the present invention.
Figure 2:
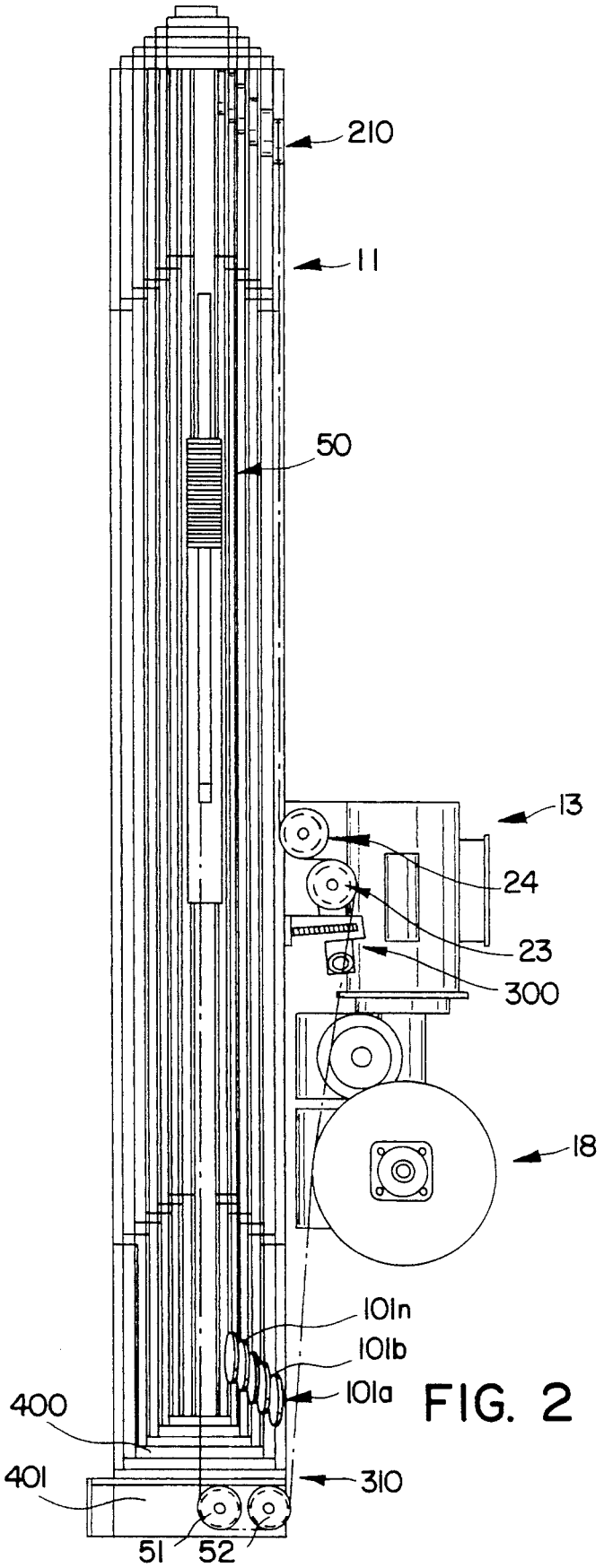
FIG. 2 is a cross-sectional view of the power mast assembly in accordance with one embodiment of the present invention.
Figure 3:
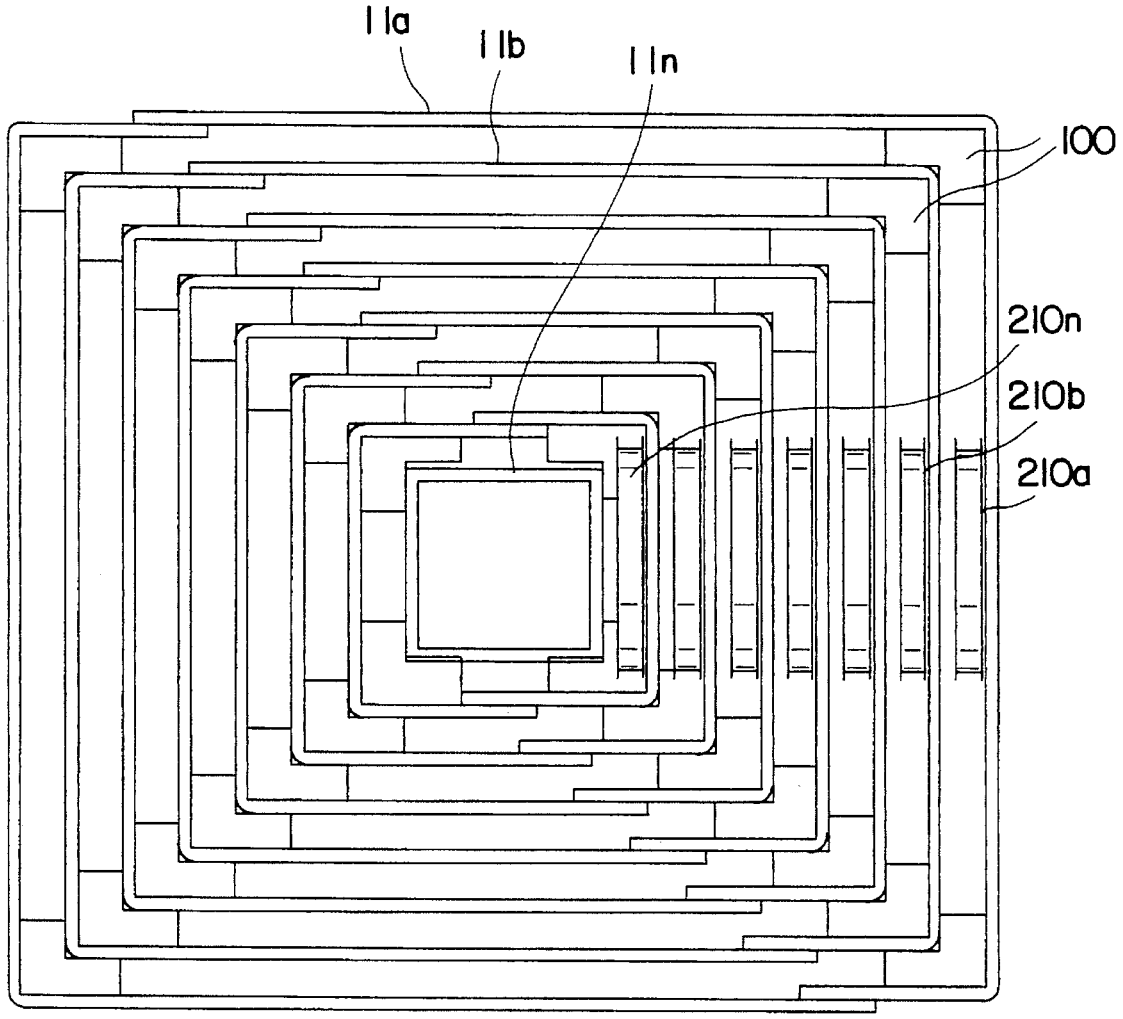
FIG. 3 is a top view of the top half of the power mast assembly in accordance with the present invention.
Figure 4:
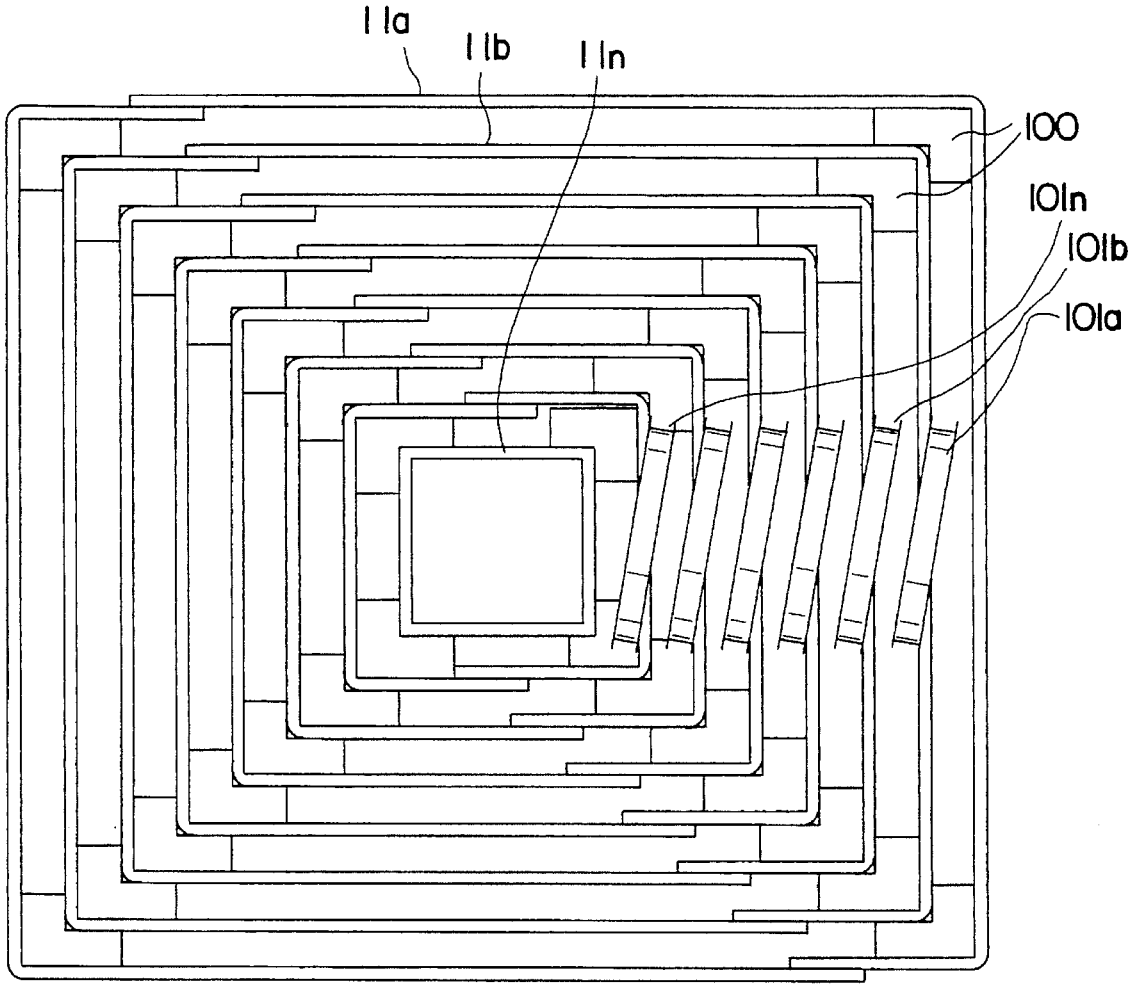
FIG. 4 is a top view of the bottom half of the power mast assembly in accordance with the present invention.

Turning first to FIG. 1, there is generally shown a power mast 10 having a plurality of individual mast sections 11*a*–11*n*. In the embodiment shown, there are seven such individual sections providing an overall extended height of 30 feet, but it should be understood that the invention is not in any way limited thereto; the number of mast sections 11 and the height of each section being a function of the total height desired for the device. For example, eight mast sections extending to an overall height of 43 feet is one such alternative and is shown in FIGS. 3 and 4. Each section is preferably formed of aluminum, and when in the retracted position, each section sits on a respective tier of pyramid 400 in base 401. (FIG. 2).

In order for the power mast to telescope properly, close tolerances on the order of about +0.003" must be observed for each individual mast section. All but the smaller mast sections (usually only the inner mast section) are formed from a brake press, whose dies are shimmed until the suitable tolerances are achieved. As can be best seen in FIGS. 3 and 4, each brake-press formed mast section is composed of two identical "U" shaped sections which are then secured to one another in an overlapping fashion; thus, each such section is slightly asymmetrical. Preferably, these mast sections are assembled using a jig to clamp the two sections in place, and then the sections are rivetted together.

The smaller mast sections, typically the innermost section (2"×2") in the embodiment shown, is too small to be assembled using this technique of overlapping flange sections. Accordingly, such mast sections can be formed as an extruded tube. (It should be understood that depending upon the dimensions of each mast section, other mast sections may require extrusion in view of their small dimensions. Generally, dimensions less than about 2 inches in length can use extrusions to achieve the tolerances necessary.) Since the innermost section is extruded, it is symmetrical. Bearings (discussed below) can be used to compensate for the symmetry of extruded sections versus the asymmetry of die-formed sections so that proper telescoping occurs.

Figure 8:
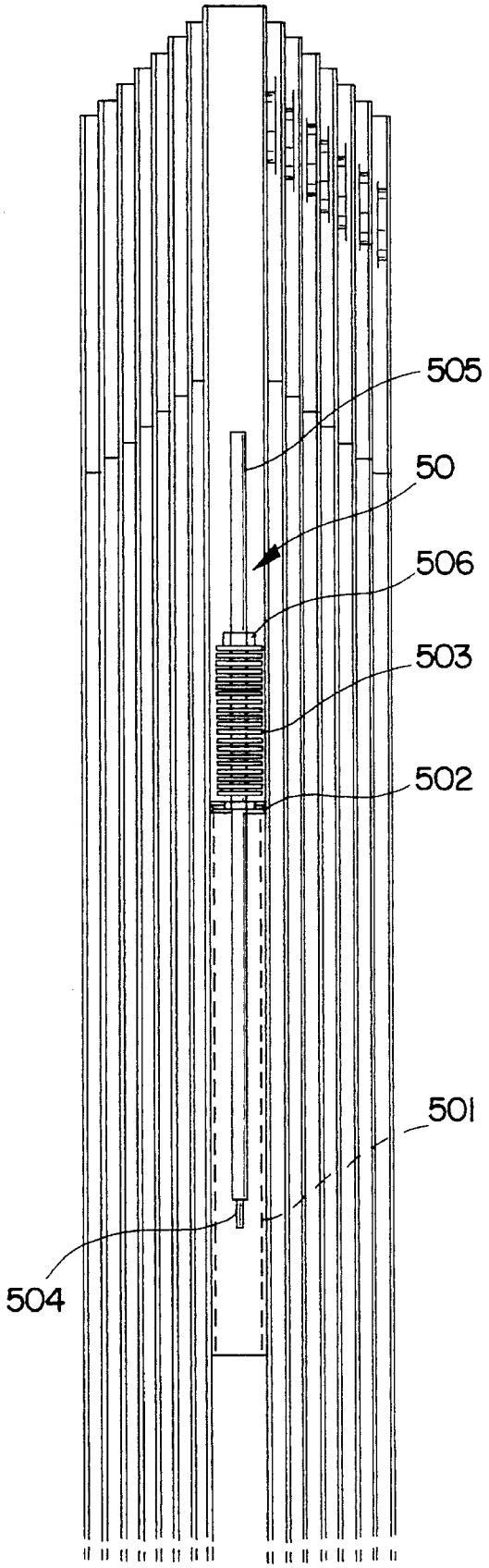
FIG. 8 is partial cross-sectional view of the power mast showing the spring/rod assembly in accordance with the present invention.

Each inside mast section includes top and bottom slide bearings/stops 100, 700 secured to each corner, top and bottom, preferably Delrin type bearings. As seen in FIG. 3, the top bearings 100 are mounted at the inside of any given mast section (except the inside 2"×2" section) even with the top edge. As seen in FIG. 4, the bottom bearings 700 are mounted at the outside corners even with the bottom edge (except for the outermost section). Each bearing 100, 700 is appropriately dimensioned to accommodate any asymmetry of a mast section. In one embodiment, the pulley side of the mast has a 7/16" space between sections, which is dictated by the space needed to accommodate the cable/pulley system (discussed below), and the bearings on this side are dimensioned appropriately. On the non-pulley side of the mast, the same space requirements are not of concern, and a space between mast sections of ⅜" has been found to be suitable, with the bearings on this side being suitable dimensioned. This space is adequate to allow for bearing thicknesses sufficient to receive machine screws for mounting. The bearings 100 define space between each mast section 11, and allow each inside mast section to smoothly slide up and down the adjacent outer mast section. In addition, as the power mast assembly is raised, the bottom bearings/stops 700 from one mast section contact the top bearings/stops 100 from the next mast section (FIG. 8), which causes the one mast section to stop and the raising of the next mast section to begin. The full surface contact at the corners and the total length of overlap greatly reduces the amount of leaning that could accumulate when all the sections are extended, and increases the wear surface and bearing life. The bearings also function as ice scrapers to clean the corners of the mast sections as it retracts, thereby preventing ice build-up from jamming the mast assembly. Some bearings on the inner two sections may have cut away portions in order to allow for cable and/or pulley clearances.

A ¼ inch aluminum mounting plate 12 is secured to the outside mast section 11*a* as shown in FIG. 1. A motor 13 of suitable size, such as 110 volt, 0.5 horsepower, 1725 rpm, is fixed to the mounting plate, and drives the cable as discussed below. The motor 13 includes a gear box 14, which preferably is an 80:1 gear box. Coupled to gear box 14 is a 36-tooth spur gear 15 and shaft 16. The spur gear 15 is in turn coupled to a 108 tooth spur gear 17 linked to a spiral cut 9" cable drum 18 via a common shaft 19 and keyway. This cable drum assembly is mounted on the outside mast section 11*a* via a ¼" aluminum saddle 20. Shaft 19 is retained by a pair of SF-10 bearings 21 (one shown) mounted to each side of the saddle 20.

Turning now to FIG. 2, angled bottom pulleys 101*a*–101*n* are shown fixed to respective mast sections. Specifically, angled pulley 101*a* is fixed to first inside mast section 11*b;* angled pulley 100*b* is secured to second inside mast section 11*c*, etc. Each angled pulley is angled so that the cable, when threaded through each pulley 101, enters the pulley from one side of the mast section and exits through the other side of the mast section, as best seen in FIG. 4 (FIG. 4 showing an eight mast section embodiment). To that end, an aperture is formed in mast sections 11*a*–11*n* in which each angled pulley sits. The aperture must be large enough to accommodate each pulley 101 and to allow the cable threaded through each pulley to travel unimpeded. The angled pulleys 101*a*–101*n* function as transition pulleys, allowing the cable to continue to the next mast section 11.

A plurality of top parallel mounted pulleys 210*a*–210*n* are secured to respective mast sections as shown in FIGS. 1 and 3 (Figure showing an eight mast section embodiment). Parallel pulley 210*a* is secured to the inside of outer mast section 11*a;* parallel pulley 210*b* is secured to the inside of first inside mast section 11*b*, etc.

It should be understood by those skilled in the art that means for transitioning or changing the direction of the cables can be used other than pulleys.

The up cable 300 (preferably a ⅛" diameter cable with a strength level three times the load) is threaded through the assembly as follows. A first end of the up cable 300 is fixed to the spiral grooved cable drum 18 by suitable means, such as through a hole (not shown) in the surface of the grooved section that extends out the side of drum 18, where the cable can be fixed. The cable 300 then is threaded over a first up cable transition pulley 23, under a second up cable transition pulley 24, and into the interior of the mast assembly through an aperture in the outer mast 11*a* in which transition pulley 24 partially sits. The cable 300 travels up towards first top parallel pulley 210*a*, wraps around pulley 210*a*, and then travels down towards first angled pulley 101*a*. As the cable 300 wraps around angled pulley 101*a*, its path is moved from the space between outer mast 11*a* and first inside mast 11*b*, to the space between first inside mast 11*b* and second inside mast 11*c*. Once in the latter space, the cable path extends up towards parallel pulley 210*b*, wraps around pulley 210*b*, and then extends down to angled pulley 101*b*. As the cable 300 wraps around angled pulley 101*b*, its path is moved from the space between first inside mast 11*b* and second inside mast 11*c*, to the space between second inside mast 11*c* and third inside mast 11*d*. This threading continues from parallel pulley 210 to angled pulley 101 until the space between the second-to-last mast section and the innermost mast section is reached, where the cable terminates and is fixed to the innermost mast section, preferably near the bottom thereof.

The down cable 310 (preferably a ⅛" diameter cable with a strength level three times the load) is threaded as follows. One end of the down cable 310 is fixed to a threaded rod and tension spring assembly 50 (FIGS. 2 and 8) positioned inside the innermost mast section. The down cable 310 exits the assembly at the bottom of the innermost mast section whereupon it transitions over one or more transition pulleys (two shown) 51, 52 so that it is in proper alignment with the spiral grooved cable drum 18, where its other end is secured in a fashion similar to up cable 300.

Cable drum 18 is of a circumference sufficient to allow the total length of the extended or retracted cable to lay on the drum in a single wrap. This is critical to maintain a 1:1 ratio between the up cable 300 and the down cable 310 sequence from the stowed position. In this stowed position, the drum 18 begins fully wrapped with the pull down cable 310, except for a single wrap of the up cable 300. As the drum pulls in the up cable 300 to elevate the mast, it correspondingly pays out the down cable 310 so that the up cable 300 literally "chases" the down cable 310 across the spiral surface of the drum 18.

As the up cable 300 raises its top load in addition to the weight of the mast sections, the cable begins to stretch. However, the down cable 310 does not see this load and will go slack as the up cable 300 stretches, causing the down cable 310 to jump off pulleys or tangle on the drum 18. To prevent this, a threaded rod and tension spring assembly 50 (FIG. 8) is secured to a tube (1¾×1¾×⅛") 501 attached to the inside of the innermost mast section. A ¼" aluminum plate is welded to the top of the tube 501 and forms a spring seat 502. The spring 503 is adjusted to a point where it has adequate compression to compensate for the slack in the down cable 310 equal to the stretch in the up cable 300. However, the spring 503 must not be overtightened or overrated to the point that it preloads the cable system. The spring 503 is secured at its upper end to the rod 505 by a nut 506 as shown. The lower end of spring 503 sits on spring seat 502. The rod 505 must be of a suitable length to allow the nut 506 to be threaded and secure the spring, and then compress the spring 3–4 inches to preload it, in order to compensate for up cable stretching. The down cable is attached to the spring 503 by any suitable means, such as through a loop 504 welded to the bottom of the threaded rod 505. The rod 505 also must be of a suitable length so that loop 504 is sufficiently spaced from the spring seat 502 so that there is adequate travel (generally about 3–4 inches) to compensate for the stretching in the up cable. Preferably the spring 503 has about 6–8 inches of compressibility to allow for inconsistencies. A 12" die spring with about a #60 rating has been found to be suitable.

Figure 5:
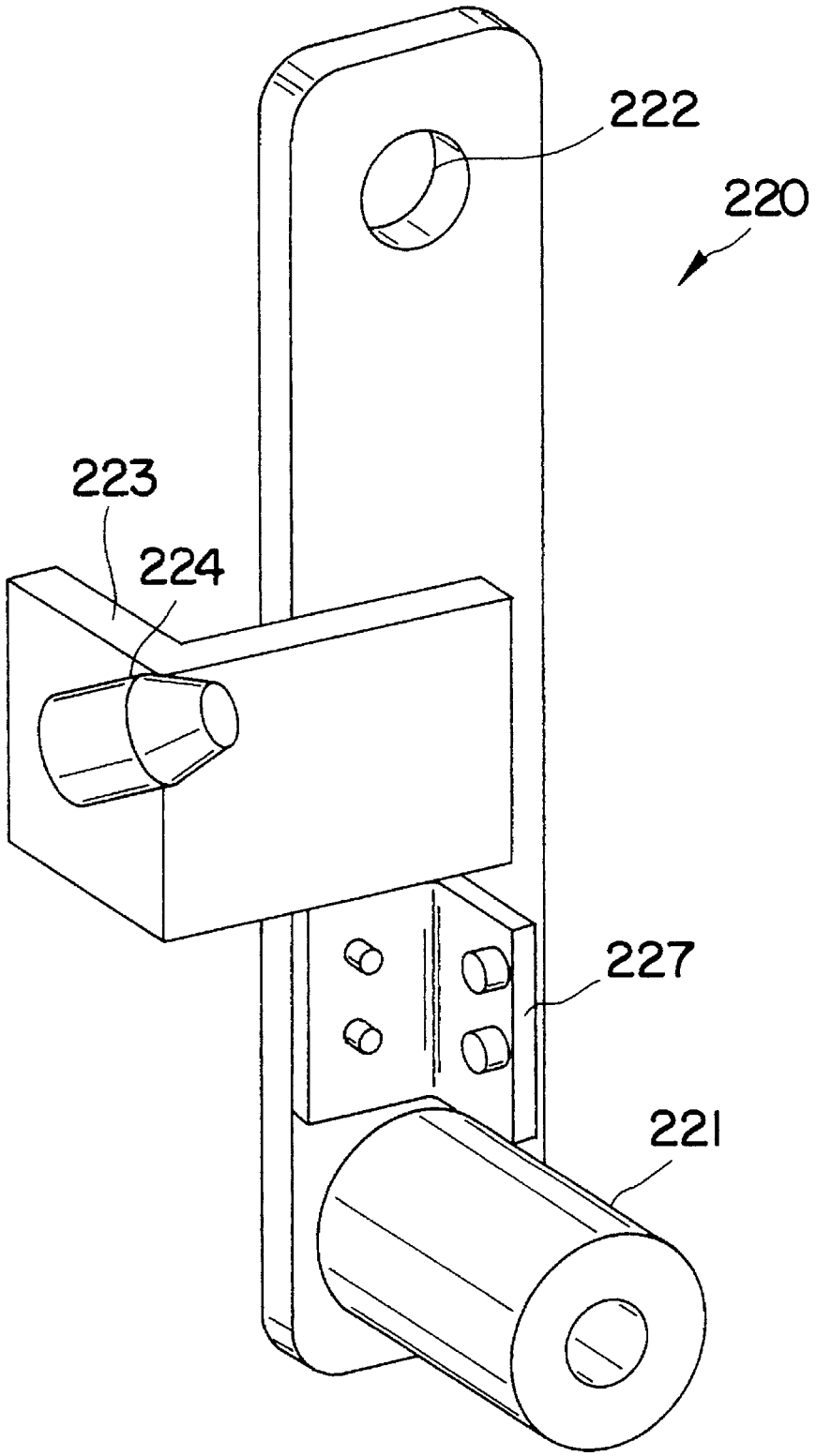
FIG. 5 is a perspective view of a slack detector/down limit actuator/up cable tensioner in accordance with one embodiment of the present invention.
Figure 6:
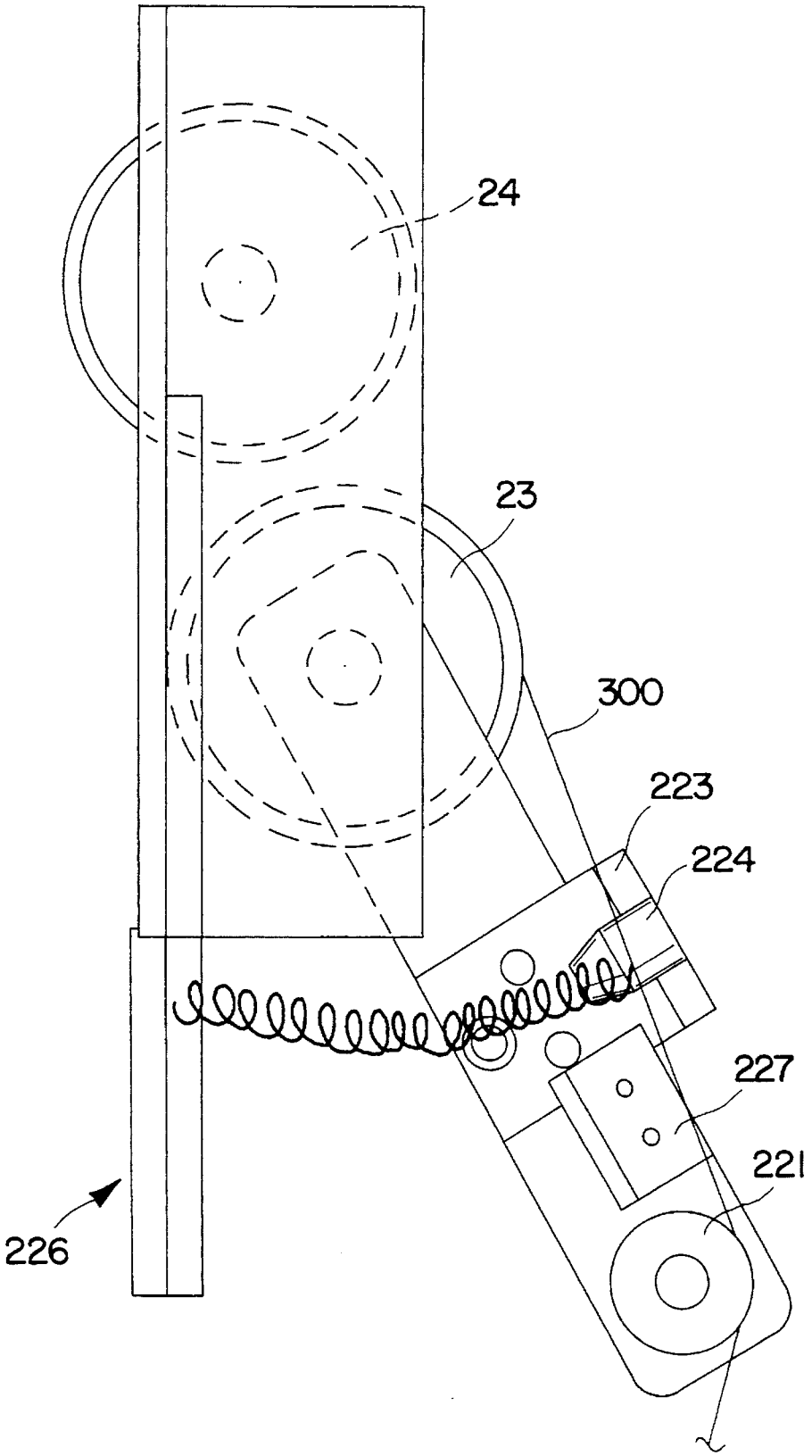
FIG. 6 is a side view of a switch sensing mechanism in accordance with one embodiment of the present invention.
Figure 7:
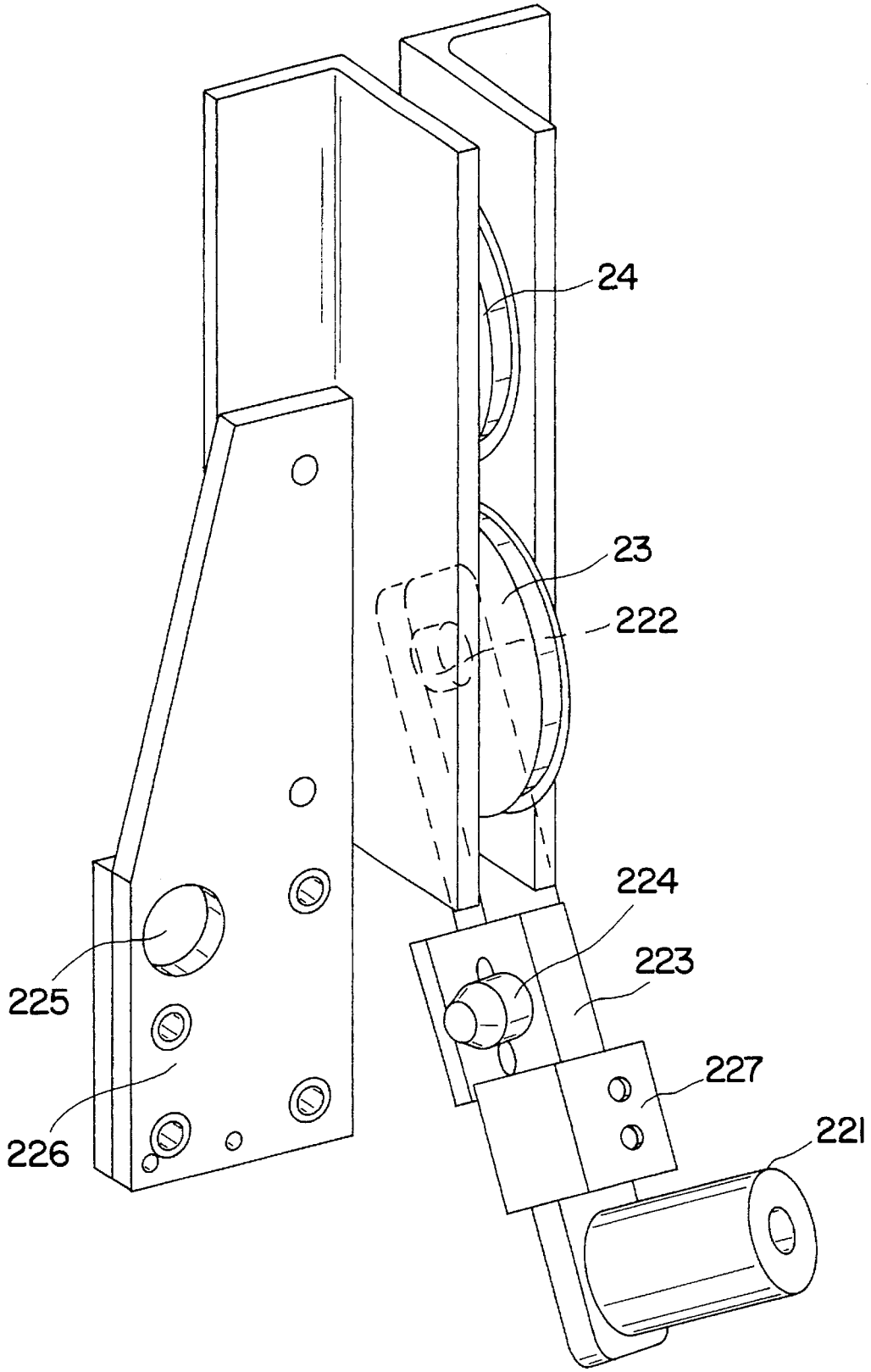
FIG. 7 is a perspective view of the switch sensing mechanism of FIG. 6.

Turning now to FIGS. 5–7, in accordance with a preferred embodiment of the present invention there is shown a switch mechanism for automatically shutting the mast system off when the mast is in the retracted position. A slack detector arm 220 (FIG. 3) includes a fly wheel 221 at its lower end and an aperture 222 at its upper end. An angled bracket 223 is secured to the arm 220. The angled bracket 223 includes a spring aperture 224 for housing one end of a slack detector spring (not shown). Also secured to arm 220 is an angled switch tab 227.

The slack detector arm 220 is pivotally mounted via aperture 222 to cable transition pulley 23 as shown in FIGS. 6 and 7. Up cable 300 is threaded over fly wheel 221 prior to reaching the first cable transition pulley 23 as shown. The slack detector spring is positioned in spring aperture 224 and extends to second spring aperture 225 in mounting bracket 226.

In the operating position, the up cable 300 is pulled taught. This pushes the fly wheel 221 toward the body of the mast 11*a*, thereby compressing the slack detector spring. The switch tab 227 is positioned so that upon this spring compression, it triggers a down limit switch (not shown). It remains in this position until the mast is fully retracted. Once the mast is fully retracted, the up cable 300 is no longer taught and the down cable 301 compresses the spring 50 inside the innermost mast section. As the up cable 300 goes slack, the slack detector spring pushes arm 220 away from the mast 11*a*, and the switch tab disengages the down limit switch, causing the motor 13 to shut off.

Figure 9:
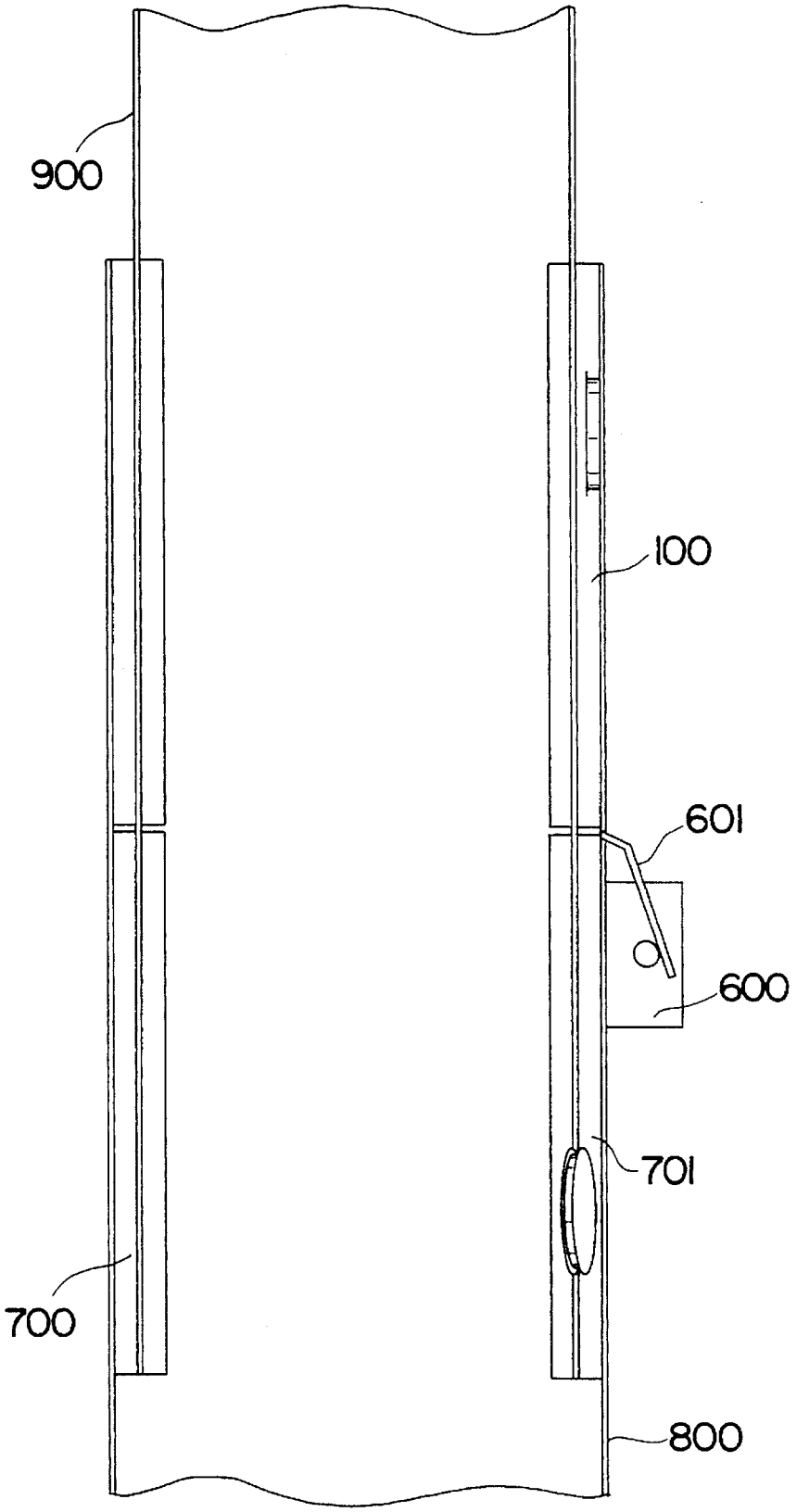
FIG. 9 is a partial cross-sectional view of the power mast showing the up-limit switch in accordance with one embodiment of the present invention.

Preferably the power mast is also equipped with means for automatically turning off the motor once the mast reaches its fully extended position. To that end, FIG. 9 shows an up-limit switch 600 mounted on the largest non-moving mast section 800. The switch 600 includes a switch rod 601, and the switch is electrically coupled to motor 13. As the largest moving section 900 reaches full extension, one of its bottom bearings 700 contacts switch rod 601 and pushes it back, causing the motor 13 to stop. Note also that bottom bearing 700 contacts top bearing 100, providing a mechanical stop.

The telescoping design according to the present invention allows for a maximum lean of up to about 10 degrees, depending upon the top and top load conditions. By simply turning off the motor, the power mast can be extended (or retracted) to any desired height.

What is claimed is:

1. A power mast assembly, comprising:

an outer stationary mast section having an inner and outer surface;

an innermost mast section having an inner and outer surface, said innermost mast section having spring means secured therein;

at least one inner telescoping intermediate mast section between said innermost mast section and said outer stationary mast section, said at least one inner telescoping intermediate mast section having an inner and outer surface;

a base supporting said outer stationary mast section, said innermost mast section and said inner telescoping intermediate mast section;

a plurality of up pulleys, one being secured to said inner surface of said outer stationary mast section, and each of the remaining plurality of up pulleys being secured to said inner surface of one of said inner telescoping intermediate mast sections;

a plurality of transition pulleys, one being secured to said base, and each of the remaining plurality of transition pulleys being secured to one of said inner telescoping intermediate mast sections, each transition pulley being vertically spaced from said up pulleys;

an up cable having a first end and a second end, said first end being secured to said innermost mast section, said up cable being sequentially threaded from said innermost mast section through said transition and up pulleys and out said outer stationary mast section, said up cable second end being secured to means for driving said up cable, said means for driving said up cable comprising a spiral grooved cable drum; and a down cable having a first end and a second end, said down cable first end being secured to said spring means, said down cable being threaded from said spring means, out said innermost mast section and through transition means aligning it with said spiral grooved cable drum, said down cable second end being secured to said spiral grooved cable drum; said spiral grooved cable drum being suitably dimensioned such that only a single wrap of up cable or down cable lay on said drum at any given time.

2. The power mast assembly of claim 1, wherein said spiral grooved cable drum is coupled to a motor.

3. The power mast assembly of claim 1, further comprising means for stopping said first and second drive means when said mast is in the fully retracted position.

4. The power mast assembly of claim 3, wherein said means for stopping said first and second drive means comprises a slack detector arm having a fly wheel around which said up cable is threaded, and a spring having one end engaged on said slack detector arm an another end engaged on said outer stationary mast section, whereby when said up cable is taught, said spring is compresses and pushes said arm toward said outer mast section causing a down limit switch to be engaged, and when said up cable is slackened, said spring decompresses and pushes said arm away from said outer mast section causing said down limit switch to be disengaged and said drive means to stop.

5. The power mast assembly of claim 1, further comprising means for sensing when said mast is in a fully extended position.

6. The power mast assembly of claim 1, wherein said base has an inner and an outer surface, and wherein each of said plurality of transition pulleys secured to each inner telescoping intermediate mast section extends between said inner and outer surface of each of said inner telescoping intermediate mast sections, and wherein said one of said transition pulleys secured to said base extends between said inner and outer surface of said base.

* * * * *